US009234670B2

(12) United States Patent
Lee

(10) Patent No.: US 9,234,670 B2
(45) Date of Patent: Jan. 12, 2016

(54) AIR CONDITIONING DEVICE AND CONTROL METHOD OF THE SAME

(75) Inventor: Juyoun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 209 days.

(21) Appl. No.: 13/282,602

(22) Filed: Oct. 27, 2011

(65) Prior Publication Data

US 2012/0103556 A1 May 3, 2012

(30) Foreign Application Priority Data

Oct. 28, 2010 (KR) ..... 10-2010-0105951

(51) Int. Cl.

| | |
|---|---|
| ***G05D 23/32*** | (2006.01) |
| ***F25B 19/00*** | (2006.01) |
| ***F25B 49/00*** | (2006.01) |
| ***G05D 23/19*** | (2006.01) |
| ***H04Q 9/06*** | (2006.01) |
| ***F24F 11/00*** | (2006.01) |

(52) U.S. Cl.

CPC ..... *F24F 11/006* (2013.01); *F24F 11/0012* (2013.01); *F24F 2011/0061* (2013.01); *F24F 2011/0063* (2013.01); *F24F 2011/0065* (2013.01); *F24F 2011/0073* (2013.01)

(58) Field of Classification Search

CPC ..... F24F 11/0012; F24F 2011/0065; F24F 2011/0061; F24F 2011/0063

USPC ..... 62/157–158, 231, 125; 236/46 C

See application file for complete search history.

(56) References Cited

U.S. PATENT DOCUMENTS

| | | | | |
|---|---|---|---|---|
| 7,623,912 | B2 * | 11/2009 | Akselrod et al. | 600/513 |
| 2008/0295531 | A1 * | 12/2008 | Song et al. | 62/157 |
| 2010/0176208 | A1 * | 7/2010 | Lee et al. | 236/49.3 |

FOREIGN PATENT DOCUMENTS

| | | | |
|---|---|---|---|
| CN | 101315215 | A | 12/2008 |
| EP | 1 811 238 | A2 | 7/2007 |
| EP | 1 998 118 | A1 | 12/2008 |
| EP | 2 206 984 | A1 | 7/2010 |
| JP | 05187679 | A * | 7/1993 |
| JP | H05 187679 | A | 7/1993 |
| JP | 2006 317074 | A | 11/2006 |
| KR | 10-2007-0076855 | A | 7/2007 |
| KR | 10-2008-0001293 | A | 1/2008 |

OTHER PUBLICATIONS

Chinese Office Action dated Nov. 4, 2013 for corresponding Application No. 201110342595.5.

European Search Report dated Jan. 3, 2014 for corresponding Application No. 11186839.4.

* cited by examiner

*Primary Examiner* — Frantz Jules
*Assistant Examiner* — Steve Tanenbaum
(74) *Attorney, Agent, or Firm* — KED & Associates LLP

(57) ABSTRACT

An air conditioning device and a control method of the same are provided. The air conditioning device may include a controller configured to control the air conditioning device based on a control signal input at an input device, in accordance with at least one sleep mode to provide heating or cooling to a designated room at a first operation temperature and a second operation temperature that is higher than the first operation temperature, the first and second operation temperatures being alternately applied multiple times. This may provide a user with an air conditioning function which corresponds to the user's sleeping patterns and provide for a more pleasant sleeping environment.

14 Claims, 6 Drawing Sheets

AIR CONDITIONING DEVICE AND CONTROL METHOD OF THE SAME

CROSS-REFERENCE TO RELATED APPLICATION(S)

This application claims priority under 35 U.S.C. §119 to Korean Application No. 10-2010-0105951 filed in Korea on Oct. 28, 2010, whose entire disclosure is hereby incorporated by reference as if fully set forth herein.

BACKGROUND

1. Field

This relates to an air conditioning device and a control method of such an air conditioning device.

2. Background

The human sleep state may include a REM (rapid eye movement) sleep state and a Non-REM sleep state which are alternately. The REM sleep state may be observed three to five times in one night at regular intervals. Physical changes observed in the REM sleep state may include decline of temperature control in addition to rapid eye movement. It may be difficult to precisely define the REM sleep state medically or scientifically. When classifying or analyzing the human sleep state, human brainwave analysis may be used.

The REM sleep state may be a state in which physiological loss of consciousness is repeated periodically. REM sleep in infants typically occupies up to 50% of total sleep. As humans age, the amount of REM sleep tends to decrease gradually. The Non-REM sleep period may be related to physical recovery, while the REM sleep period may be related to mental recovery, or a period for recovery of brain cells. If REM sleep is insufficient or interfered with repeatedly, side effects may include, for example, memory loss and cognitive power loss.

As mentioned above, the REM sleep state does not seem to respond to environment or to have declined sensory or reflex function. If heating of a room is required during the sleep period in which the REM sleep and the Non-REM sleep alternate with each other, sensory, reflex and temperature control functions may decline. If air conditioning which targets either of the sleep periods is performed, response to physiological requirements may not be appropriate, resulting in fatigue after sleep, memory loss, and loss of cognitive power.

BRIEF DESCRIPTION OF THE DRAWINGS

The embodiments will be described in detail with reference to the following drawings in which like reference numerals refer to like elements, wherein.

DETAILED DESCRIPTION

As follows, exemplary embodiments will be described in detail in reference to the accompanying drawings. However, the present disclosure is not limited to the above embodiments and may be specified in various types. It is to be understood by those of ordinary skill in this technological field that other embodiments may be utilized, and structural, electrical, as well as procedural changes may be made without departing from the scope as embodied and broadly described herein. Reference will now be made in detail to specific embodiments, examples of which are illustrated in the accompanying drawings. Wherever possible, the same reference numbers will be used throughout the drawings to refer to the same or like parts.

Figure 1:
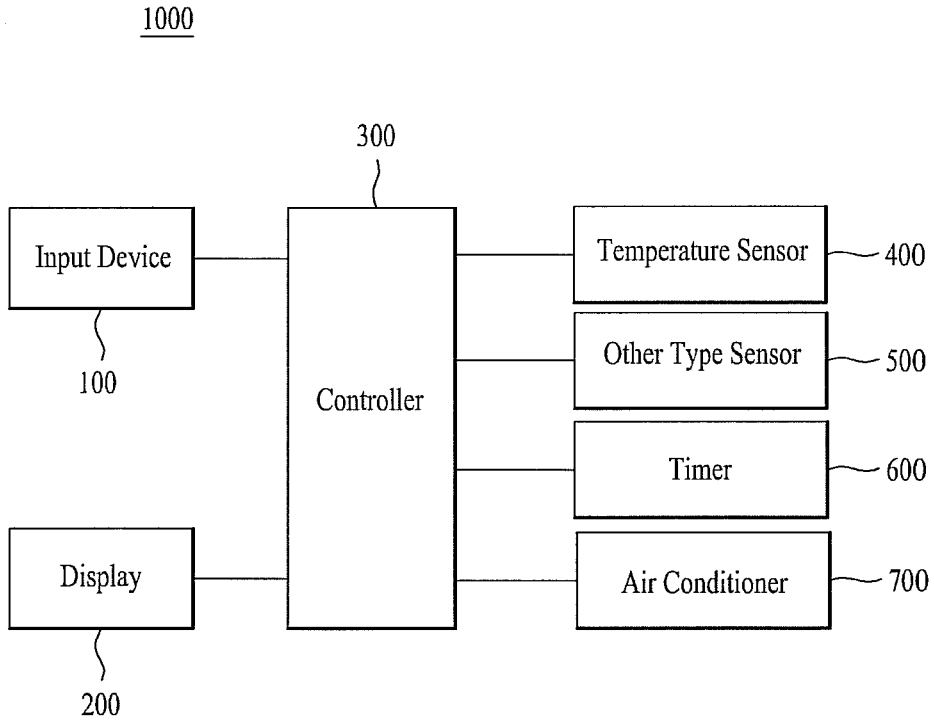
FIG. 1 is a block diagram of an air conditioning device as embodied and broadly described herein.

FIG. 1 is a block diagram of an air conditioning device according to an embodiment as broadly described herein. The air conditioning device 1000 includes an input device 100 that receives a control signal input, a temperature sensor 400 configured to measure temperatures of a room which to be air conditioned, an air conditioner 700 having a variety of air conditioning parts used for air conditioning of the room based on the control signal input at the input device 100, and a controller 300 configured to control the air conditioner 700 based on the control signal input at the input device 100.

The input device 100 may be a control panel or remote controller which is provided in an indoor unit of the air conditioning device 1000. An operation mode, a type of air discharge, an operation temperature and the like may be input at the input device 100 by a user.

The air conditioner 700 may include various parts provided in an outdoor unit and an indoor unit to provide for the air-conditioning of the room. The air conditioning device 1000 as embodied and broadly described herein may include a plurality of sensors and a timer 600. The sensors may include a temperature sensor 400. The temperature sensor 400 may be provided in each of the indoor and outdoor units of the air conditioning device 1000.

A temperature sensed by the temperature sensor 400 may be used as control parameter of the controller 300 together with the operation mode selected by the user. Like the temperature sensor 400, information on the time counted by the timer 600 may be used as control parameter of the controller 300 when each of the operation modes is performed.

In addition to, or instead of, the temperature sensor 400, the sensors 500 may include a human body sensor, a humidity sensor, a pollution level sensor and the like.

Input information input at the input device 100 or information related to an operation state may be displayed on a display 200 provided in the indoor unit of the air conditioning device 1000.

Information which may be displayed on the display 200 may include operation state, a type of operation air discharge, an operation temperature, an operation mode and other such information.

Figure 2A:
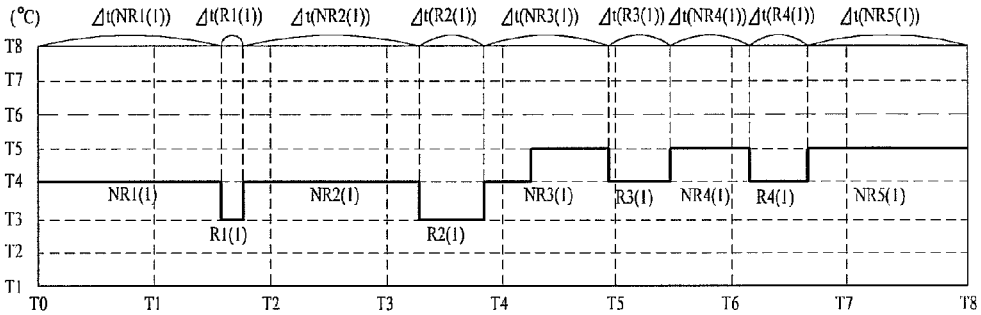
FIGS. 2A and 2B are graphs of operation temperatures with respect to time according to a control method of an air conditioning device as embodied and broadly described herein.
Figure 2B:
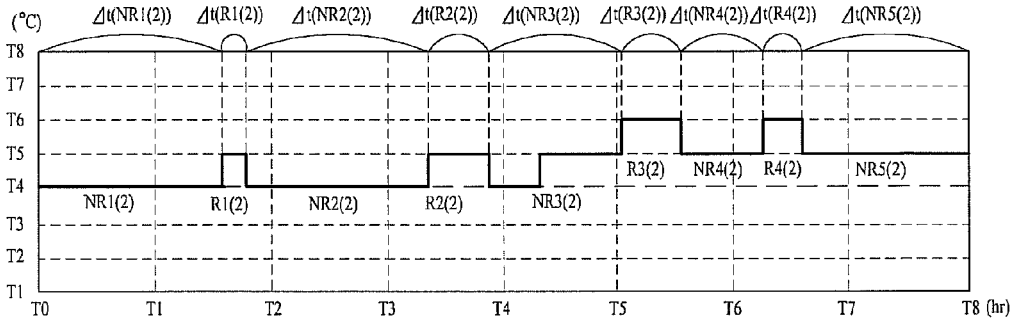

FIGS. 2A and 2B illustrate changes in operation temperatures with respect to time according to a control method of the air conditioning device as embodied and broadly described herein.

The control method of the air conditioning device according to embodiments as broadly described herein provides a REM sleep period and a Non-REM sleep period classified based on the human sleep state.

Generally, the temperature control function of the human body may decline in the REM sleep period, compared with the Non-REM sleep period. As a result, temperatures of the room in which to the subject is sleeping may be controlled differently in order to satisfy an optimal sleep condition.

Specifically, the embodiment shown in FIG. 2A illustrates that the operation temperature of the indoor unit in the Non-REM sleep period may be set higher than the operation temperature of the indoor unit in the REM sleep period.

The control method of the air conditioning device as embodied and broadly described herein may vary the temperatures based on the Non-REM sleep period and the REM sleep period classified thereby.

According to the control method, the Non-REM sleep period and the REM sleep period may be classified and then Non-REM sleep period operation steps (NR1(1) to NR5(1)) and REM sleep period operation steps (R1(1) to R4(1)) may be alternatively performed.

According to the embodiment shown in FIG. 2A, operation temperatures of the REM sleep period operation steps (R1(1) to R4(1)) may be lowered at preset time intervals while the Non-REM sleep period operation steps (NR1(1) to NR5(1)) are performed.

In the first embodiment shown in FIG. 2A, a first temperature (T1) of a first Non-REM sleep period operation step (NR1(1)) and a second temperature (T2) of a second Non-REM sleep period operation step (NR2(1)) may be the same as a fourth temperature (T4). A fourth Non-REM sleep period operation step (NR4(1)) and a fifth Non-REM sleep period operation step (NR3(1)) may performed at the same temperature as a fifth temperature (T5).

An operation temperature of a third Non-REM sleep period operation step (NR3(1)) performed after a second REM sleep period operation step (R2(1)) may be increased from the fourth temperature (T4) to the fifth temperature (T5) which is higher than the fourth temperature (T4) while the third Non-REM sleep period operation step (NR3(1)) is performed.

A first Non-REM sleep period duration time [Δt(NR1(1))] to a fifth Non-REM sleep period operation time [Δt(NR5(1))] which are the duration times of the first Non-REM sleep period operation step (NR1(1)) to the fifth Non-REM sleep period operation step (NR5(1)) may be increased after being decreased gradually. A first REM sleep period duration time [Δt(R1(1))] to a fourth REM sleep period duration time [Δt (R4(1))] which are the duration times of the first REM sleep period operation step (R1(1)) to the fourth REM sleep period operation step (R4(1)) may be decreased after being increased gradually.

In certain embodiments, the first REM sleep period operation step (R1(1) to the fourth REM sleep period operation step (R4(1)) may be performed at intervals of approximately 80~100 minutes based on experimental data associated with REM sleep. The performance time may be 5~60 minutes. Other intervals/durations may also be appropriate.

Different from the embodiment shown in FIG. 2A, the embodiment shown in FIG. 2B increases the operation temperature of the REM sleep period operation step at preset intervals while the Non-REM sleep period operation step is performed.

The temperature control function of the sleeping human may decline in the REM sleep period arranged between the Non-REM sleep periods. Depending on a particular case, the operation temperature may be increased or lowered in the REM sleep period to provide an optimized control method of the air conditioning device as embodied and broadly described herein.

In addition, a temperature (T4) of an entering stage of sleep may be lower than a temperature (T5) of a final sleep stage based on characteristics of the user. This may take into consideration the characteristic that the body temperature in a sleep state may be lower than the body temperature in a Non-sleep state. To ease entry into the sleep state, an operation temperature of the indoor unit in the final stage of the sleep state may be set higher than an operation temperature of the indoor unit in when entering the sleep state.

As mentioned above, the control method of the air conditioning device as embodied and broadly described herein may be closely related with the characteristics of the Non-REM sleep period and the REM sleep period which composes the human sleep state.

A normal sleep state may start with the Non-REM sleep, and then the REM sleep and the Non-REM sleep may be alternately repeated, ending with the Non-REM sleep.

As a result, an air conditioning step provided in the control method of the air conditioning device as embodied and broadly described herein may start with a Non-REM sleep period air conditioning step and may finish with a Non-REM sleep period air conditioning step.

According to temperature changes of the control method of the air conditioning device shown in FIGS. 2A and 2B, the control method starts when a first Non-REM sleep period air conditioning step (NR1) is performed for a first Non-REM sleep period air conditioning time [Δt(NR1)]. The control method finishes when a fifth Non-REM sleep period air conditioning step (NR5) is performed for a fifth Non-REM sleep period air conditioning time [Δt(NR5)].

However, the frequency of the Non-REM sleep period air conditioning step is not necessarily limited to five times, as illustrated in the exemplary embodiments discussed above, and may be varied by the frequency of REM sleep period air conditioning step.

Figure 3A:
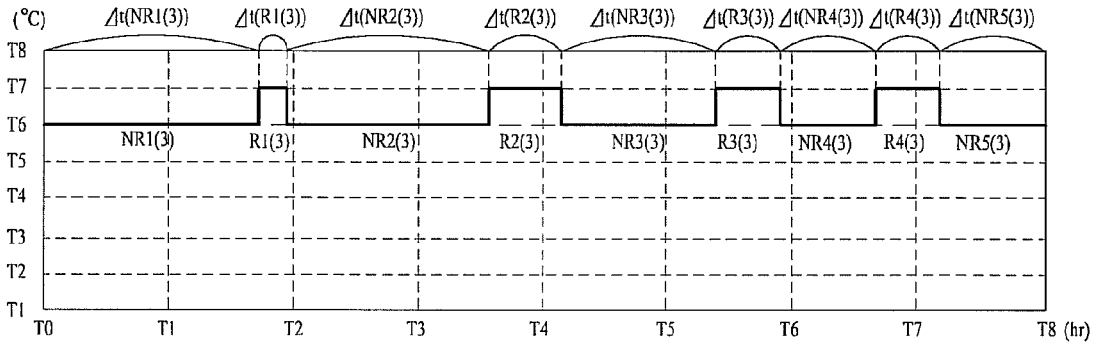
FIGS. 3A and 3B are graphs of operation temperatures with respect to time according to another embodiment of a control method of an air conditioning device as embodied and broadly described herein.
Figure 3B:
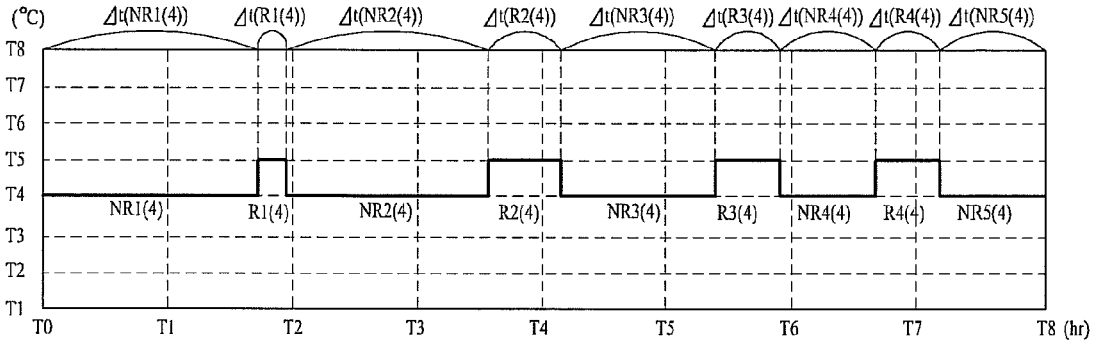

FIGS. 3A and 3B illustrate temperature changes with respect to time according to another embodiment as broadly described herein. Repetitive description of this embodiment will be omitted, compared with the description the above embodiment in reference to FIGS. 2A and 2B as appropriate.

The control method according to this embodiment includes a first operation temperature heating step configured to heat the room to be air conditioned at a first operation temperature for a preset duration time, a second operation heating step configured to heat the room at a second operation temperature which is higher than the first operation temperature for a preset duration time after the first operation temperature heating step. The first operation temperature heating step and the second operation temperature heating step may be repeated multiple times according to this embodiment of the control method.

The first operation temperature heating step and the second operation temperature heating step may correspond to a Non-REM sleep period air conditioning step and a REM sleep period air conditioning step, respectively, which will be described later.

In the embodiment shown in FIGS. 3A and 3B, like the embodiments shown in FIGS. 2A and 2B, the Non-REM sleep period air conditioning step and the REM sleep period air conditioning step may repeated, taking into consideration the characteristics of the Non-REM sleep and the REM sleep composing the human sleep state.

Different from the embodiments shown in FIGS. 2A and 2B, in the embodiment shown in FIGS. 3A and 3B the operation temperature of the Non-REM sleep period air conditioning step may the same at the entering stage and the final stage of the sleep state.

In other words, the operation temperature in the entering stage of the sleep state may be a sixth temperature (T6) which is the operation temperature of the first Non-REM sleep period air conditioning step (R1(4)). The operation temperature in the final stage of the sleep stage is the sixth temperature (T6) which is the operation temperature of the fifth Non-REM sleep period air conditioning step (R5(4)).

The operation temperature of each REM sleep period air conditioning step performed between each two of the Non-REM sleep period air conditioning steps may be a seventh temperature (T7) which is higher than the sixth temperature (T6). This is essentially the same as each of the REM sleep period air conditioning steps.

The embodiment shown in FIG. 3B represents a similar pattern to the embodiment shown in FIG. 3A. However, the operation temperature in the entering stage of the sleep state may be a fourth temperature (T4) which is the operation temperature of the first Non-REM sleep period air conditioning step (R1) and the operation temperature in the final stage of the sleep state is the fourth temperature (T4) which is the operation temperature of the fifth Non-REM sleep period air conditioning step (NR5). The operation temperature of each REM sleep period air conditioning step performed each two of the Non-REM sleep period air conditioning steps is a fifth temperature (T5) higher than the fourth temperature (T4), which is different from the embodiment of FIG. 3(*a*).

According to the embodiment shown in FIG. 3A, the first temperature (T1) to eighth temperature (T8) may be 18 degrees Celsius to 24 degrees Celsius at one degree intervals. Because of that, the first operation temperature may be 18 to 24 degrees Celsius. The difference between the first operation temperature and the second operation temperature may be 0.5 degrees Celsius to 2 degrees Celsius.

The control method of the air conditioning device as embodied and broadly described herein may provide a sleep mode of the air conditioning device in a season which requires heating. The first operation temperature with a range of 18 degrees Celsius through 24 degrees Celsius may be higher than the temperature of external air.

As a result, the embodiment shown in FIG. 3A may have a different range than the operation temperatures of the embodiment shown in FIG. 3B.

However, the embodiments shown in FIGS. 3A and 3B may have a common characteristic in that the operation temperature of each REM sleep period air conditioning step (R) performed between each two of the Non-REM sleep period air conditioning steps (NR) may be set higher than the operation temperature of each of the Non-REM sleep period air conditioning steps.

In other words, according to the control method of the air conditioning device as embodied and broadly described herein, the REM sleep period air conditioning step sets the operation temperature of the air conditioning device to be higher than the operation temperature in the Non-REM sleep period air conditioning step, taking into consideration the characteristics of the human body temperature control in an environment which requires heating of the room.

Like the embodiment(s) shown in FIGS. 2A/2B, in the embodiment(s) shown in FIGS. 3A/3B the REM sleep period air conditioning step may be performed at intervals of approximately 80~100 minutes. In certain embodiments, the duration time may be 5~60 minutes.

In other words, the second operation temperature heating step corresponding to the REM sleep period air conditioning step which repeated multiple times may be repeated at intervals of 5 to 60 minutes. The duration time of each second operation temperature heating step repeated multiple times may be 5 though 60 minutes.

In the graphs shown in FIGS. 3A and 3B, the second operation temperature heating step is repeated four times. However, the repetition frequency may be set flexibly based on the sleep time. For example, the second operation temperature heating step may be repeated at least three times or more. Taking into consideration a normal sleep time, it may be repeated three to six times.

The duration time of the first operation temperature heating step corresponding to the Non-REM sleep period air conditioning step and the duration time of the second operation temperature heating step corresponding to the REM sleep period air conditioning step are not shown precisely in FIGS. 3A/3B. As the REM sleep of humans may occupy approximately 25% of total sleep, the total sum of the duration times of the second operation temperature heating steps may be set in a range of two times to four times as large as the total sum of the duration times of the first operation temperature heating step.

As shown in FIGS. 3A/3B, the duration time of the REM sleep period air conditioning step may have a sequentially increasing period. The duration time of the Non-REM sleep period air conditioning step may have a gradually decreasing period. This takes into consideration the characteristics of the REM sleep and the Non-REM sleep. Specifically, the duration time of the REM sleep period air conditioning step (the second operation temperature heating step) may be decreased after being increased. The duration time of the Non-REM sleep period air conditioning step (the first operation temperature heating step) may be increased after being decreased.

In detail, according to the embodiment shown in FIG. 3A, a first REM sleep period air conditioning step duration time [Δt(R1(3))] to a fourth REM sleep period air conditioning step duration time [Δt(R4(3))] which are the duration times of the first REM sleep period air conditioning step (R1(3)) to the fourth REM sleep period air conditioning step (R4(3)) may be decreased after being increased gradually.

According to the embodiment shown in FIG. 3A, a first Non-REM sleep period air conditioning step duration time [Δt(NR1(3))] to a fifth Non-REM sleep period air conditioning step duration time [Δt(NR5(3))] which are the duration times of the first Non-REM sleep period air conditioning step (NR1(3)) to the fifth Non-REM sleep period air conditioning step (NR5(3)) may be decreased after being increased gradually.

Also, according to the embodiment shown in FIG. 3B of which only the operation temperature is different from the embodiment shown in FIG. 3A, a first REM sleep period air conditioning step duration time [Δt(R1(4))] to a fourth REM sleep period air conditioning step duration time [Δt(R4(4))] which are the duration times of the first REM sleep period air conditioning step (R1(4)) to the fourth REM sleep period air conditioning step (R4(4)) may be set decreased after increased gradually. A first Non-REM sleep period air conditioning step duration time [Δt(NR1(4))] to a fifth Non-REM sleep period air conditioning step duration time [Δt(NR5(4))] which are the duration times of the first Non-REM sleep period air conditioning step (NR1(4)) to the fifth Non-REM sleep period air conditioning step (NR5(5)) may be decreased after being increased gradually.

The control method of the air conditioning device as embodied and broadly described herein may be set to finish after the Non-REM sleep period air conditioning is performed.

According to the embodiment shown in FIGS. 3A/3B, the control method starts with when the first Non-REM sleep period air conditioning step (NR1) is performed for a first Non-REM sleep period air conditioning time [Δt(NR1)] and it finishes when the fifth Non-REM sleep period air conditioning step (NR5) is performed for a fifth Non-REM sleep period air conditioning time [Δt(NR5)].

According to the embodiments shown in FIGS. 2A/2B and 3A/3B, the Non-REM sleep period air conditioning step and the REM sleep period air conditioning step may be repeated five times and six times, respectively. The repetition frequency may be increased or decreased as appropriate.

As mentioned above, the air conditioning device may include the input device 100 configured to receive a control signal input used to control the air conditioning device 1000, the temperature sensor 400 configured to measure the temperature of the room, the air conditioner 700 having the variety of parts used for air conditioning the room, and the controller 300 configured to control the air conditioner 700 based on the control signal input at the input device 100, having at least one heating sleep mode input thereto to heat the room at a first operation temperature and a second operation temperature higher than the first operation temperature, which alternate with each other, multiple times.

In other words, a plurality of air conditioning modes may be stored in a memory provided in the controller 300 and the sleep mode is stored therein, such that the user may select the sleep mode for pleasant sleep.

The plurality of sleep modes may be stored in the controller 300 to allow the user to select one of them, taking into consideration individual sleep characteristics or sleep time.

For example, the four sleep modes shown in FIGS. 2A/2B and 3A/3B may be input and the user may be allowed to select a sleep mode which can provide the most pleasant sleep, determined, for example, through trial and error.

The first operation temperature or the second operation temperature according to the control method of the air conditioning device may be different from each other in the plurality of sleep modes. As shown in FIGS. 2A/2B, the first operation temperature may be variable in a single sleep mode. Although not shown in FIGS. 2A/2B, the difference between the first operation temperature and the second operation temperature may be variable.

Figure 4:
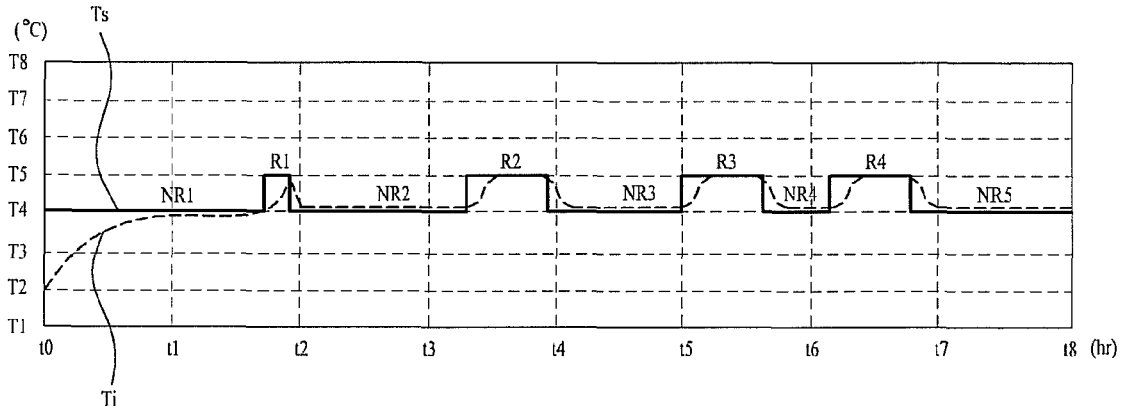
FIG. 4 is a graph of operation temperatures and changes in indoor room temperatures.

FIG. 4 illustrates changes of the operation temperature and changes of the internal temperature in the room according to the control method of the air conditioning device as embodied and broadly described herein. Specifically, the control method of the operation temperatures in the air conditioner described in reference to FIG. 4 may be essentially the same as the control method described in reference to FIG. 3B.

The temperature (Ts) of the air conditioning device may correspond to a target value of the internal temperature of the room set by the controller 300 of the air conditioner, and may be different from the current internal temperature (Ti) of the room.

In other words, the temperature (Ts) shown in FIG. 4 may have the operation temperature of the Non-REM sleep period air conditioning step and the operation temperature of the REM sleep period air conditioning step which are varied in the two temperature bands of the fourth temperature (T4) and the fifth temperature (T5) alternatively at intervals of the preset duration time. However, the substantial internal temperature may be varied with a gentle curvature and may follow the operation temperature, with a predetermined time delay with respect to the changes of the operation temperature.

When the air conditioning device is put into operation according to the control method as embodied and broadly described herein, with the room not being heated, the internal temperature of the room may slowly converge to the fourth temperature (T4) which is an initial operation temperature from the second temperature (T2) which is an initial internal temperature. When the Non-REM sleep period air conditioning step and the REM sleep period air conditioning step are repeated in earnest, the internal temperature (Ti) of the room may be changed at preset intervals, only to have convex temperature change.

In an aspect of control for the internal temperature, not control for the operation temperature, the air conditioning device 1000 including the air conditioner 700 having various air conditioning parts used for air conditioning the room, the temperature sensor 400 configured to measure the temperature of the room, and the controller 300 configured to control the air conditioner 700 to control the internal temperature of the room measured by the temperature sensor 400 to decrease after increasing or to increase after decreasing for a preset duration time at preset intervals with respect to a preset reference temperature.

According to the graph shown in FIG. 4, the internal temperature of the room may be decreased after being increased at a reference temperature for a preset duration time at preset intervals. In a case of performing the control of the operation temperature as shown in FIG. 2A, the graph may have a pattern of being increased after being decreased at a preset reference temperature for a preset duration time at preset intervals.

The controller 300 may control the air conditioner 700 to make the internal temperature change within a range of 0.5 to 2 degrees Celsius.

When the operation temperature of the air conditioning device is controlled as shown in FIG. 2B, a preset temperature which is the reference temperature of the internal temperature in the room may increase one time within a range of 18 to 24 degrees Celsius although not shown in FIG. 4.

Figure 5A:
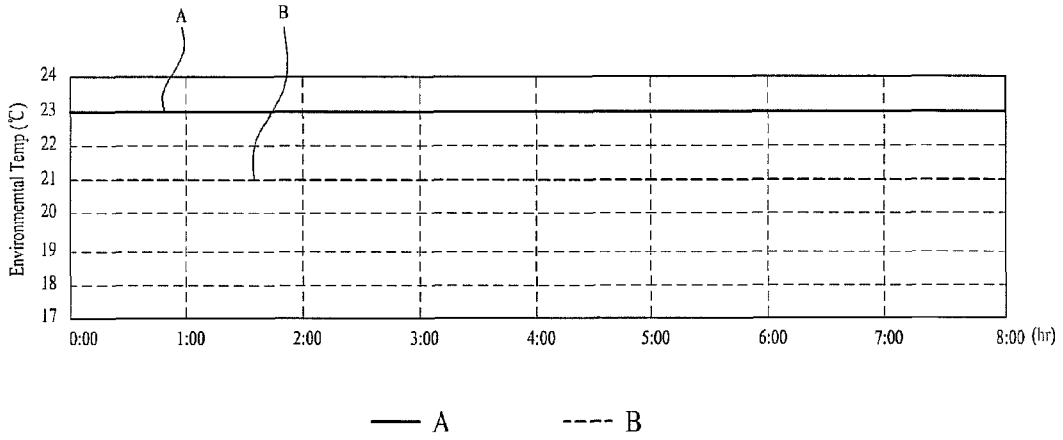
FIGS. 5A and 5B are graphs of a comparison between the operation temperature according to a control method of air conditioning device as embodied and broadly described herein and operation temperatures according to several other control methods.
Figure 5B:
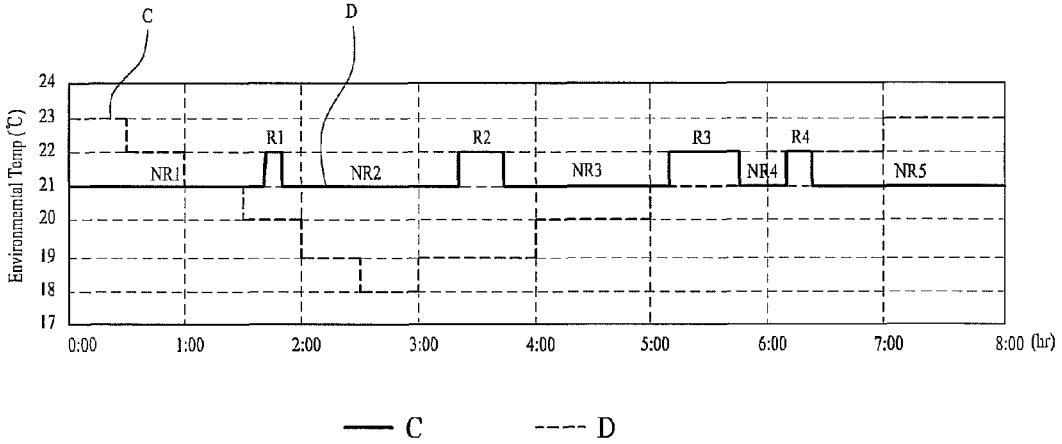

FIGS. 5A and 5B are graphs illustrating a comparison between the operation temperature according to the control method of the air conditioning device as embodied and broadly described herein and an operation temperature according to different control methods of the air conditioning device.

For ease of explanation, a single cycle of the control method as sleep mode is set to be totally 8 hours. It is assumed that each operation temperature will change within a range of 18 to 24 degrees Celsius.

Specifically, a sleep mode 'A' shown in FIG. 5A is a control method which maintains the operation temperature at 23 degrees Celsius constantly. A sleep mode 'B' shown in FIG. 5A is a control method which maintains the operation temperature at 21 degrees Celsius constantly.

A sleep mode 'C' shown in FIG. 5B gradually decreases the operation temperature from the operation temperature in the entering stage of sleep and the sleep mode 'C' gradually increases the temperature up to the operation temperature in the entering stage of the sleep again when the operation temperature reaches a preset temperature, to control the operation temperature.

A sleep mode 'D' shown in FIG. 5B shows changes of the operation temperature in the operation mode of the air conditioning device shown in FIG. 3B or 4.

Polysomnography (PSG) may be performed according to each of the sleep modes of the air conditioning device shown in FIGS. 5A and 5B. Polysomnography (PSG) is a kind of a multi-parametric test which measures the quality and quantity of sleep to detect somnipathy and sleep disorder as a diagnostic tool in sleep medicine. Polysomnography measures physiologic and physical signals generated from human bodies during sleep, to detect somnipathy and sleep disorder. Here, a brainwave, an electrooculogram, an electromyogram (EMG), an electrocardiogram (ECG), arterial blood, oxygen saturation, chest and abdomen breathing exercises, respiratory air flow, stertorous respiration and a body position may be measured to observe respiration and sleep and a condition of awakening. The PSG calculates sleep duration, dream duration, loudness of a snore, how long it takes to fall asleep, a frequency of awakening in the middle of sleep, sleep efficiency and fraction and distribution of sleep stages. The PSG is a test used to determine whether a physiological phenomenon generated during sleep is pathological.

The PSG may be performed with respect to experimenters in a single group based on each of the sleep modes. Test results encapsulated in the following Table 1 may be drawn from the PSG.

First, as the awakening frequency while a normal sleep process is performed one time decreases, the sleep efficiency and sleep quality may be determined to be increasing. As a result, it may be determined that the sleep efficiency is increasing as the awakening frequency is decreasing.

Based on the result shown in Table 1, the sleep mode 'A' and the sleep mode 'B' which maintain the operation temperature of the air conditioning device constantly, without the Non-REM sleep period and the REM sleep period may be measured large, compared with the sleep mode 'C' and the sleep mode 'D' in which the awakening frequency changes the operation temperature. As a result, if the awakening frequency is increasing, the increased frequency may be one of reasons which interfere with deep sleep.

A ratio of a deep sleep period occupying in an entire sleep process is measured the highest in the sleep mode 'C' according to the control method of the air conditioning device.

The awakening frequency in the sleep mode 'B' is similar to the awakening frequency in the sleep mode 'A'. However, a high ratio of deep sleep is achieved in an aspect of deep sleep efficiency. Because of that, the operation temperature in the sleep mode 'B' may be preferable as an operation temperature in a basic operation temperature or in the Non-REM sleep period air conditioning step.

In a case of the sleep mode 'D', the awakening frequency is low like the sleep mode 'C' and a range of changes of the operation temperatures may be wide in a sleep state, only to interfere with deep sleep.

It is measured that the ratio of the REM sleep related to the sleep efficiency is the highest in the sleep mode 'C' of the control method of the air conditioning device as embodied and broadly described herein.

In other words, it is analyzed that the sleep mode 'A' having no temperature change related to the ratio of the REM sleep or the sleep mode 'D' having temperature change and a wide range of the temperature change have the low ratio of the REM sleep in the total sleep process, with low possibility of entering into the REM sleep.

TABLE 1

| | Awakening Frequency | Deep Sleep Frequency [%] | REM Sleep [%] |
|---|---|---|---|
| Sleep mode A | 9.1 | 8.6 | 16.8 |
| Sleep mode B | 8.8 | 10.3 | 18.9 |
| Sleep mode C | 5.2 | 12.5 | 19.3 |
| Sleep mode D | 5.6 | 10.2 | 16.0 |

In conclusion, it may be more helpful to maintain pleasant sleep if the temperature is varied based on the REM sleep period than if the operation temperature of the air conditioning device is maintained at a constant temperature. It may be identified that the operation temperature of the Non-REM sleep period air conditioning step as a basic operation temperature is near 21 degrees Celsius.

It may be identified that the range of temperature changes is not as wide as the sleep mode 'C', although the temperature is changed based on the sleep period.

Figure 6:
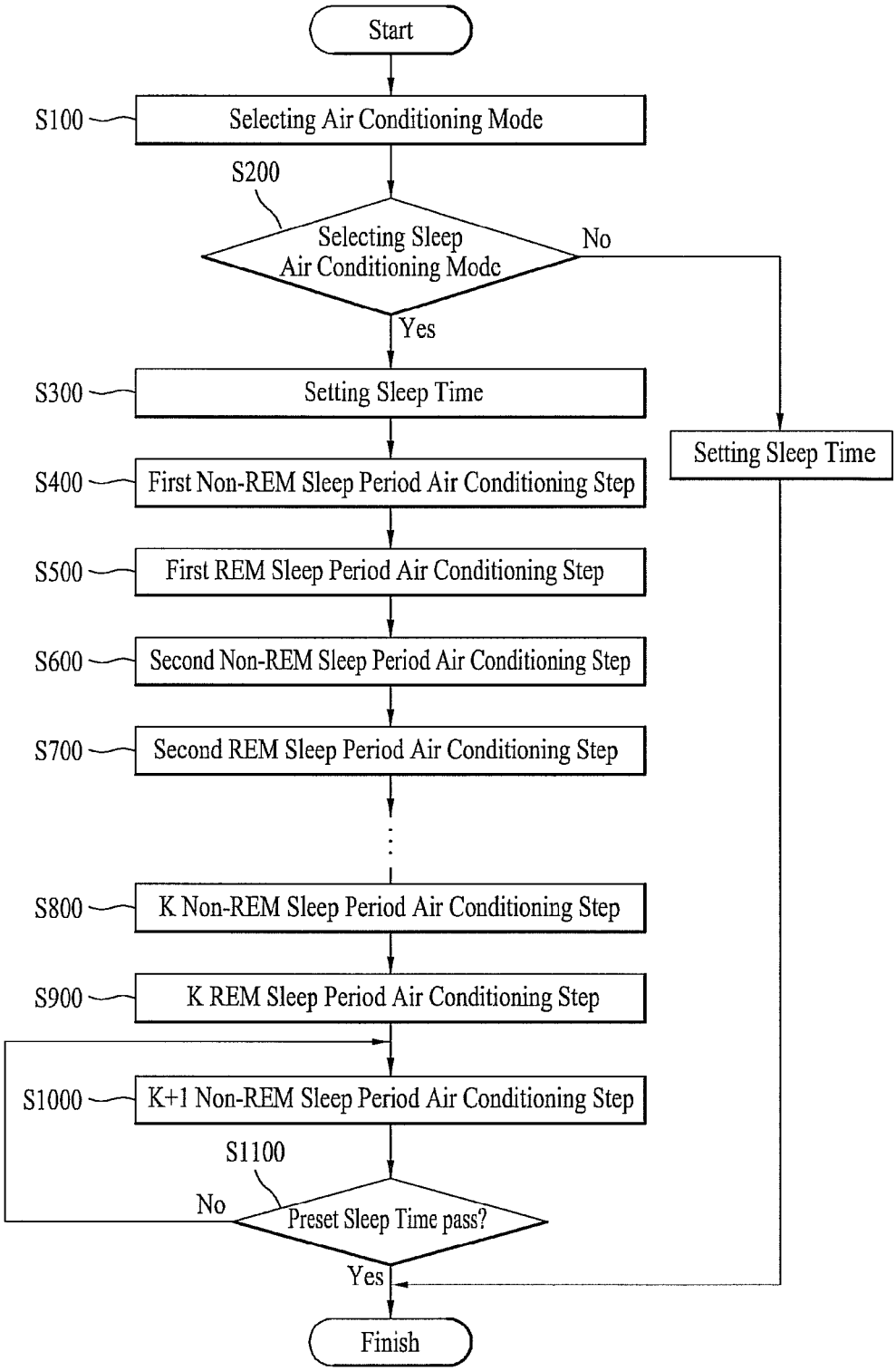
FIG. 6 is a flowchart of a control method of the air conditioning device as embodied and broadly described herein.

FIG. 6 is a flowchart of a control method of an operating method of an air conditioning device as embodied and broadly described herein.

First, the user may select an air conditioning mode of the air conditioning device via the input device 100 (see FIG. 1) of the air conditioning device (S100).

After the user selects the air conditioning mode (S100), it is determined whether the selected air conditioning mode is a sleep mode (S200). When the air conditioning mode selected by the user is the sleep mode based on the result of the determination, the user may set a sleep time (S300).

The frequency of the REM sleep period air conditioning step may be determined based on the set sleep time.

The air conditioning method of the air conditioning device as embodied and broadly described herein may be performed by repeating the Non-REM sleep period air conditioning step and the REM sleep period air conditioning step. In the entering stage and the final stage of the sleep state as mentioned above, the Non-REM sleep period air conditioning step is performed.

As a result, when the sleep time is set by the user (S200), the first Non-REM sleep period air conditioning step (S400), the first REM sleep period air conditioning step (S500), the second Non-REM sleep period air conditioning step (S600), the second REM sleep period air conditioning step (S700) to the K Non-REM sleep period air conditioning step (S800) and the K REM sleep period air conditioning step (S900) are performed alternatively.

The sleep air conditioning mode finishes when the K+1 Non-REM sleep period air conditioning step (S1000) is performed.

It is determined whether the set sleep time has elapsed (S1100) and the K+1 Non-REM sleep period air conditioning step (S1000) is performed constantly until the set sleep time has elapsed.

When the air conditioning mode selected by the user (S100) is not the sleep air conditioning mode, the air conditioning device may be operated in another selected air conditioning mode (S1200).

Embodiments as broadly described herein are directed to an air conditioning device and a control method of the same which is optimized based on characteristics of human sleep.

A control method of an air conditioning device as embodied and broadly described herein may include a first operation temperature heating step configured to heat a room, which is an object of air conditioning, at a first operation temperature for a preset duration time; and a second operation temperature heating step configured to heat the room at a second operation temperature, which is higher than the first operation temperature, for a preset duration time after the first operation temperature heating step, wherein the first operation temperature heating step and the second operation temperature heating step are repeated multiple times.

The duration time of the first operation temperature heating step repeated multiple times may be increased after being decreased gradually.

The duration time of the second operation temperature heating step repeated multiple times may be decreased after being increased gradually.

In certain embodiments, the second operation temperature heating step repeated multiple times may be repeated at intervals of 80 to 100 minutes.

The duration time of the second operation temperature heating step repeated multiple times may be 5 to 60 minutes.

The sum total of the duration times of the second operation temperature heating step may be double to quadruple the sum total of the duration times of the first operation temperature heating step.

In certain embodiments, the second operation heating step may be repeated three to six times.

In certain embodiments, the first operation temperature may be higher than a temperature of external air.

The first operation temperature may be 18 degrees Celsius to 24 degrees Celsius.

A difference between the first operation temperature and the second operation temperature may be 0.5 degree to 2 degrees.

A duration time of the REM sleep period air conditioning step may include a gradually increasing period.

A duration time of the Non-REM sleep period air conditioning step may include a gradually increasing period.

The control method of the air conditioning device may finish after the Non-REM sleep period air conditioning step is performed.

In another embodiment as broadly described herein, a control method of an air conditioning device may include a Non-REM sleep period air conditioning step configured to heat a room, which is an object of air conditioning, at a preset operation temperature; and a REM sleep period air conditioning step configured to heat the room by increasing the temperature after the Non-REM sleep period air conditioning step, wherein the Non-REM sleep period air conditioning step and the REM sleep period air conditioning step are repeated alternatively multiple times.

The Non-REM sleep period air conditioning step and the REM sleep period air conditioning step may be repeated three times or more.

In another embodiment as broadly described herein, an air conditioning device may include an input part configured to input a control signal to control the air conditioning device; a temperature sensor configured to measure a temperature of a room which is an object of air conditioning; an air conditioning part comprising a variety of parts for air conditioning of the room based on the control signal input from the input part; and a control part configured to control the air conditioning part based on the control signal input from the input part, with at least one heating sleep mode input thereto to heat the room at a first operation temperature and a second temperature higher than the first operation temperature multiple times, the first and second operation temperatures alternating with each other.

The preset temperature may be 18 degrees Celsius to 24 degrees Celsius.

A difference between the first operation temperature and the second operation temperature may be 0.5 degree to 2 degrees.

A duration time of the heating sleep mode may be 6 hours to 9 hours.

The heating sleep mode may start to operate at the first operation temperature and it may be operated at the second operation temperature after 1 hour to 2 hours.

The heating sleep mode may be operated at the second operation temperature for 5 minutes to 60 minutes at intervals of 80 minutes to 100 minutes, while it is operated at the first operation temperature.

In certain embodiments, the heating sleep mode may finish after a Non-REM sleep period air conditioning step is performed.

A plurality of heating sleep modes may be input to the control part, and first operation temperatures in two or more out of the plurality of the input heating sleep modes are different from each other.

In another embodiment as broadly described herein, an air conditioning device may include an air conditioning part having air conditioning parts used for air conditioning a room which is an object of air conditioning, a temperature sensor configured to measure the temperature of the room, and a control part configured to control the air conditioning part to control the internal temperature of the room measured by the temperature sensor to decrease after increasing or to increase after decrease for a preset duration time at preset intervals with respect to a preset reference temperature.

The control part may control the air conditioning part to make the temperature of the room change in a range of 0.5 degrees Celsius to 2 degrees Celsius.

The preset temperature may be within a range of 18 degrees Celsius to 24 degrees Celsius.

The preset temperature may change at least one time while the air conditioning part is operated.

In certain embodiments, the preset temperature may be increased one time within the range of 18 degrees Celsius to 24 degrees Celsius.

Therefore, an air conditioning device and a control method of an air conditioning device as embodied and broadly described herein may provide for pleasant sleep of a user by taking human sleep characteristics into consideration.

Furthermore, user fatigue after sleep, memory loss, cognitive power loss and the like may be reduced.

Still further, a heating mode which is optimized for sleep may be provided, without any supplementary configurations. As a result, productivity of the air conditioning device may be enhanced.

Any reference in this specification to "one embodiment," "an embodiment," "example embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling an air conditioning device, the method comprising:

performing a first air conditioning step at a first operation temperature for a first duration time;

performing a second air conditioning step at a second operation temperature for a second duration time after the first air conditioning step has been performed, wherein the second operation temperature is higher than the first operation temperature;

alternately repeating the first air conditioning step and the second air conditioning step multiple times to provide heating or cooling to a room;

decreasing the first duration time of the first air conditioning step and then increasing the first duration time as the first air conditioning step is repeated multiple times; and increasing the second duration time of the second air conditioning step and then decreasing the second duration time as the second air conditioning step is repeated multiple times, wherein alternately repeating the first air conditioning step and the second air conditioning step multiple times includes increasing the second operation temperature of the second air conditioning step to a third operation temperature higher than the second operation temperature after increasing the first operation temperature of the first air conditioning step to the second operation temperature and performing the first air conditioning step at the second operation temperature and the second air conditioning step at the third operation temperature multiple times in a repetitive operation, without providing the first operation temperature, after alternately repeating the first air conditioning step at the first operation temperature and the second air conditioning step at the second operation temperature multiple times.

2. The method of claim 1, wherein alternately repeating the first air conditioning step and the second air conditioning step multiple times comprises repeating the second air conditioning step at intervals of 80 to 100 minutes.

3. The method of claim 1, wherein performing a second air conditioning step at a second operation temperature for a second duration time comprises performing the second air conditioning step for 5 to 60 minutes.

4. The method of claim 1, wherein alternately repeating the first air conditioning step and the second air conditioning step multiple times comprises alternately repeating the first air conditioning step and the second air conditioning step multiple times such that a sum total of the first duration times of the first air conditioning step repeated multiple times is double to quadruple a sum total of the second duration times of the second air conditioning step repeated multiple times.

5. The method of claim 1, wherein performing a first air conditioning step at a first operation temperature comprises performing the first air conditioning step at an operation temperature of 18 degrees Celsius to 24 degrees Celsius.

6. The method of claim 1, wherein a difference between the first operation temperature and the second operation temperature is 0.5 degrees Celsius to 2 degrees Celsius.

7. A method of controlling an air conditioning device, the method comprising:

performing a Non-REM sleep period air conditioning step at an initial first operation temperature;

performing a REM sleep period air conditioning step after performing the Non-REM sleep period air conditioning step, comprising increasing the initial first operation temperature to an initial second operation temperature; and alternately performing the Non-REM sleep period air conditioning step and the REM sleep period air conditioning step multiple times in accordance with a selected sleep mode to provide heating or cooling to a room, wherein alternately performing the Non-REM sleep period air conditioning step and the REM sleep period air conditioning step multiple times comprises alternately performing each of the Non-REM sleep period air conditioning step and the REM sleep period air conditioning step three times or more, wherein performing a REM sleep period air conditioning step comprises performing the REM sleep period air conditioning step for an increasing duration time and then for a decreasing duration time as the REM sleep period air conditioning step is repeated multiple times, and increasing the initial second operation temperature to a subsequent second operation temperature that is greater than the initial second operation temperature, and wherein performing a Non-REM sleep period air conditioning step comprises performing the Non-REM sleep period air conditioning step for a decreasing duration time and then for an increasing duration time as the Non-REM sleep period air conditioning step is repeated multiple times, and increasing the initial first operation temperature to a subsequent first operation temperature that is greater than the initial first operation temperature, and wherein the Non-REM sleep period air conditioning step at the subsequent first operation temperature and the REM sleep period air conditioning step at the subsequent second operation temperature are alternately repeated multiple times, without providing the first operation temperature, after the Non-REM sleep period air conditioning step at the initial first operation temperature and the REM sleep period air conditioning step at the initial second operation temperature are alternately repeated multiple times.

8. An air conditioning system, comprising:

an input device that receives a control signal input to control operation of the air conditioning device;

a temperature sensor configured to measure a temperature of a room to be air conditioned;

an air conditioner comprising a plurality of operably coupled components that provide air conditioning to the room based on the control signal received at the input device; and a controller configured to control the air conditioner based on the control signal received at the input device, wherein the controller is configured to control the air conditioner in accordance with at least one sleep mode to provide heating or cooling to the room at a first operation temperature and a second operation temperature that is higher than the first operation temperature, the first and second operation temperatures being alternately applied multiple times, wherein the controller is configured to increase the first operation temperature to the second operation temperature and to increase the second operation temperature to a third operation temperature higher than the second operation temperature while the first and second operation temperatures are alternately applied multiple times, and wherein the controller is configured to repeat alternately the second operation temperature and the third operation temperature multiple times, without providing the first operation temperature, after repeating alternately the first operation temperature and the second operation temperature multiple times.

9. The air conditioning system of claim 8, wherein the controller is configured to operate the air conditioner in the at least one sleep mode such that the first operation temperature is 18 to 24 degrees Celsius.

10. The air conditioning system of claim 9, wherein the controller is configured to operate the air conditioner in the at least one sleep mode such that a difference between the first operation temperature and the second operation temperature is 0.5 to 2 degrees Celsius.

11. The air conditioning system of claim 8, wherein the controller is configured to operate the air conditioner in the at least one sleep mode such that a duration time of the at least one sleep mode is 6 hours to 9 hours.

12. The air conditioning system of claim 8, wherein the controller is configured to operate the sir conditioner in the at least one sleep mode such that the air conditioner begins operation at the first operation temperature and then initiates operation at the second operation temperature after 1 hour to 2 hours has elapsed.

13. The air conditioning system of claim 8, wherein the controller is configured to operate the air conditioner in the at least one sleep mode such that the air conditioner operates at the second operation temperature for 5 minutes to 60 minutes at intervals of 80 minutes to 100 minutes.

14. The air conditioning system of claim 8, wherein the at least one sleep mode comprises a plurality of sleep modes, and wherein the controller is configured to operate the air conditioner based on two or more operation temperatures that are different from each other corresponding to at least one selected sleep mode of the plurality of sleep modes.

* * * * *